US005906278A

United States Patent [19]

Ponsi et al.

[11] Patent Number: 5,906,278

[45] Date of Patent: May 25, 1999

[54] PATIENT BATHING SYSTEM

[75] Inventors: Lawrence G. Ponsi, Wheeling; Steven W. Hickman, Woodstock; Barbara T. Skiba, Chicago; Jeffrey K. Crum, Wonder Lake; Keith M. Simon, Crystal Lake, all of Ill.

[73] Assignee: Sage Products, Inc., Crystal Lake, Ill.

[21] Appl. No.: 08/944,227

[22] Filed: Oct. 6, 1997

[51] Int. Cl.[6] ..... B65D 33/16

[52] U.S. Cl. ..... 206/494; 206/210; 206/812; 221/63; 383/66; 383/113

[58] Field of Search ..... 206/210, 438, 206/581, 494, 812, 233; 383/113, 119, 66; 221/63, 64, 46

[56] References Cited

U.S. PATENT DOCUMENTS

| | | | |
|---|---|---|---|
| 1,942,917 | 1/1934 | D'Este . | |
| 2,387,217 | 10/1945 | Scott . | |
| 3,428,103 | 2/1969 | Walsh . | |
| 3,460,740 | 8/1969 | Hagen . | |
| 3,583,459 | 6/1971 | Nappe . | |
| 3,906,129 | 9/1975 | Damois . | |
| 4,185,754 | 1/1980 | Julius | 206/210 X |
| 4,521,910 | 6/1985 | Keppel . | |
| 4,552,269 | 11/1985 | Chang | 383/66 X |
| 4,570,820 | 2/1986 | Murphy | 206/210 X |
| 4,610,357 | 9/1986 | Nakamura | 383/66 X |
| 4,723,301 | 2/1988 | Chang | 383/66 |
| 4,755,064 | 7/1988 | Weber . | |
| 4,863,064 | 9/1989 | Dailey, III | 206/494 X |
| 4,881,646 | 11/1989 | Weber . | |
| 5,265,960 | 11/1993 | Shikler . | |
| 5,472,279 | 12/1995 | Lin . | |
| 5,595,786 | 1/1997 | McBride, Jr. et al. | 221/63 X |
| 5,688,394 | 11/1997 | McBride, Jr. et al. | 206/233 |
| 5,725,311 | 3/1998 | Ponsi et al. | 383/66 |

FOREIGN PATENT DOCUMENTS

| | | | |
|---|---|---|---|
| 000546369 | 6/1993 | European Pat. Off. | 393/66 |

*Primary Examiner*—Bryon P. Gehman
*Attorney, Agent, or Firm*—Lee, Mann, Smith, McWilliams, Sweeney & Ohlson

[57] ABSTRACT

A patient bathing system in the form of a sealed, flexible, hollow outer package having an inner insulating layer lining the package and forming an inner cavity. The layer is shaped by slits for forming the inner cavity. A series of impregnated washcloths are disposed within the cavity for dispensing through an elongated dispensing slit in the outer package. The package and the insulating layer are preferably microwave transparent while the impregnated washcloths absorb microwave energy so that the contents of the package can be warmed while heat is retained by the insulating layer.

30 Claims, 3 Drawing Sheets

Fig. 3.
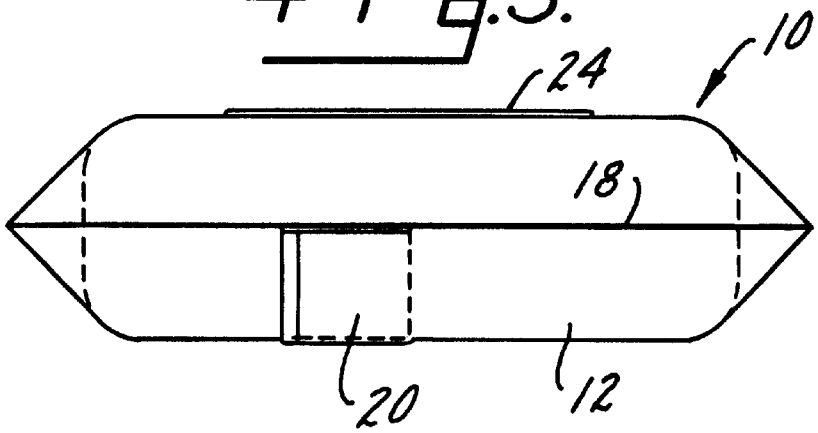
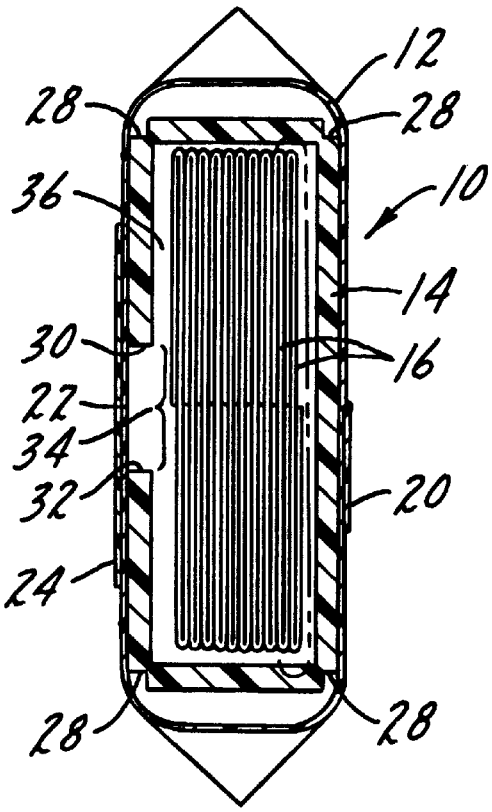
Fig. 4.
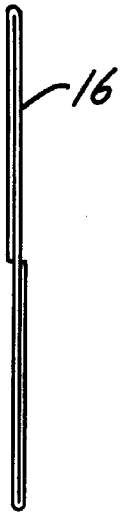
Fig. 5.

PATIENT BATHING SYSTEM

BACKGROUND OF THE INVENTION

This invention relates to personal care products, and in particular to a patient bathing system in the form of an insulated, resealable package containing a series of disposable washcloths.

Co-pending U.S. application Ser. No. 08/684,127, filed Jul. 19, 1996, now U.S. Pat. No. 5,725,311, the disclosure of which is incorporated herein by reference, discloses a patient bathing system having a label seal for sealing an elongated opening into the interior of the package. A series of washcloths are disposed within the package for dispensing. The washcloths are impregnated with an appropriate cleansing solution.

A flexible package normally has no structural integrity, and the package shape is largely dictated by the contents. When the package contains a series of impregnated washcloths or the like, however, at times it is important to have only a certain amount of cleansing solution contained within each washcloth, with the solution being evenly disbursed within the cloths. However, in a package formed by a flexible film, the package tends to squeeze the edges of the cloths contained therewithin, leading to an uneven dispersion of the solution within the cloths, and causing some cloths to have more solution than others. This result is unacceptable when the cloths are used for patient cleansing, particularly in a hospital environment where cleanliness and personal hygiene are important to resist the spread of infectious disease.

Other packaging has been developed to avoid the problem of squeezing the washcloths and causing uneven dispersion of the absorbed cleaning solution. For example, containers of rigid plastic can safely contain washcloths and the like, but such containers need to be molded, and can be quite expensive. Rigid cardboard containers also can be used, but are also expensive to manufacture, and must be appropriately lined to prevent loss of fluid from the washcloths.

Insulated packages or wrapping materials are also well known. Examples are set forth in U.S. Pat. Nos. 1,942,917; 2,387,217; 3,428,103; 3,460,740; 3,583,459; 3,906,129; 4,521,910; 4,755,064; 4,881,646; 5,265,960 and 5,472,279. While all of these structures provide insulated structures, they are complex and therefore expensive to make. In addition, many of them have no structural integrity, therefore not protecting the contents from compression.

SUMMARY OF THE INVENTION

The invention pertains to a patient bathing system comprising a sealed, flexible, hollow outer package having means for gaining access to the interior thereof. An insulating and supporting layer is provided, lining at least a portion of the outer package, thus forming an inner cavity. A plurality of washcloths are disposed within the inner cavity for dispensing through the access. Means is provided for shaping the insulating and supporting layer to form the inner cavity.

In accordance with the preferred form of the invention, the washcloths are impregnated with a cleansing solution. The washcloths can be formed from any kind of material and can be woven, non-woven or formed in any other manner, although non-woven washcloths are preferred.

The means for gaining access to the interior of the outer package includes an elongated dispensing slit in the outer package. It further includes a seal extending over the slit and adhering to the outer package. Preferably, the seal comprises a resealable seal which has a free end which does not adhere to the outer package.

The insulating and supporting layer preferably comprises a foam sheet. The foam sheet does not adhere to the outer package, which is generally rectangular in cross section, and the means for shaping the insulating and supporting layer comprises lateral partial slits in the sheet. The slits are located in general registration with corners of the rectangular outer package. In accordance with the preferred form of the invention, the partial slits comprise slots extending between opposite edges of the sheet.

The sheet is formed so that its end edges are located in alignment with the elongated slit in the outer package. The end edges are spaced from one another, forming a gap in the insulating and supporting layer, with the gap spanning the elongated slit. The washcloths are stacked within the inner cavity so that they can be dispensed one-at-a-time through the elongated dispensing slit.

The outer package and the insulating and supporting layer are preferably made of materials generally impervious to microwave energy. On the other hand, the cleansing solution with which the washcloths are impregnated is preferably a fluid that is generally absorptive of microwave energy. Accordingly, if the patient bathing system according to the invention is placed in a microwave oven, the cleansing solution is heated, and the insulating and supporting layer, being insulative, helps retain that heat within the outer package.

BRIEF DESCRIPTION OF THE DRAWINGS

The invention is described in greater detail in the following description of an example embodying the best mode of the invention, taken in conjunction with the drawing figures, in which:

FIG. 3 is an end elevational view thereof, FIG. 4 is a cross-sectional view thereof, taken along lines 4—4 of FIG. 1, FIG. 5 is an elevational view of one of the washcloths according to the invention, shown surrounded by phantom lines in FIG. 4.

DESCRIPTION OF AN EXAMPLE EMBODYING THE BEST MODE OF THE INVENTION

Figure 1:
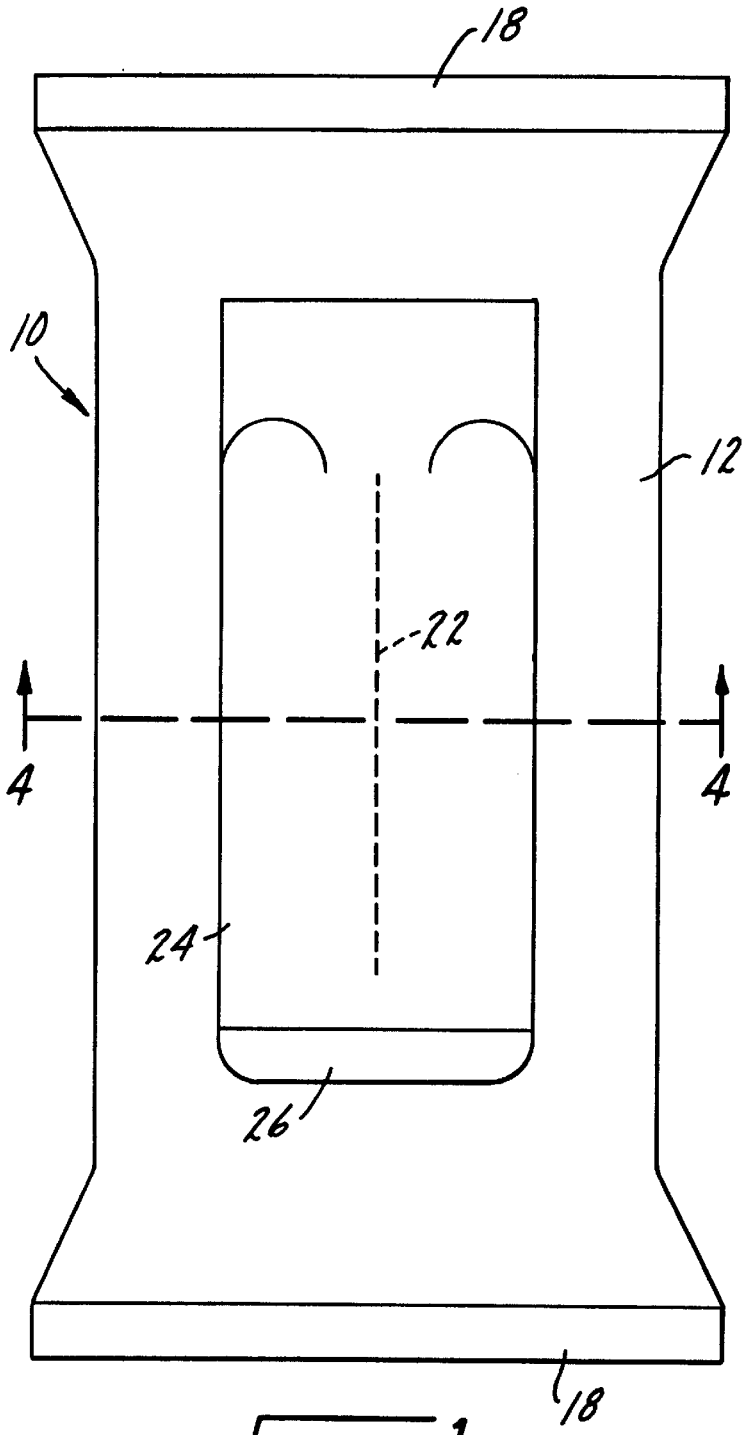
FIG. 1 is a top plan view of a patient bathing system according to the invention.
Figure 2:
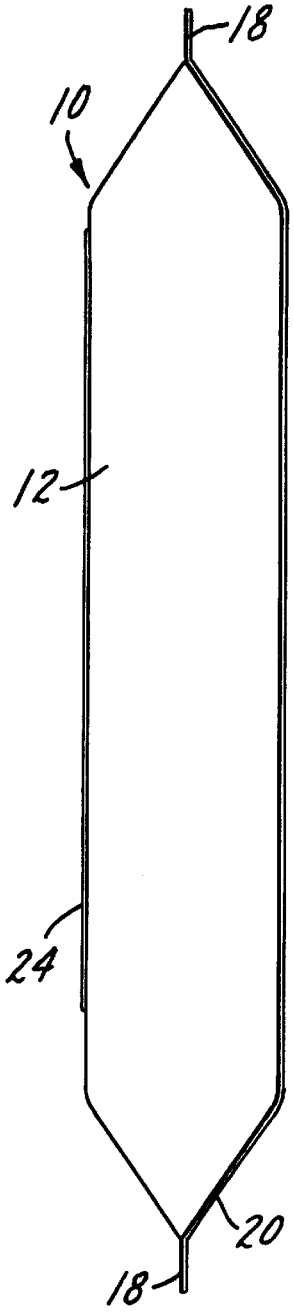
FIG. 2 is a side elevational view thereof.

A patient bathing system according to the invention is shown generally at 10 in the drawing figures. The patient bathing system 10 includes three basic components, a sealed, flexible, hollow outer package 12, an insulating and supporting layer 14, and a plurality of washcloths 16.

The outer package 12 is preferably formed from thin, plastic film in an elongated fashion having a generally rectangular cross-section, as shown in FIG. 4. The film itself has little or no ability to protect the washcloths 16 from being compressed. The package 12 has end heat seals 18 and a longitudinal thin heat seal 20. The package 12 can be conventional and formed in a conventional fashion, and therefore these aspects of the invention are not described in further detail.

For gaining access to the interior of the outer package 12, the outer package 12 includes an elongated dispensing slit 22. A seal in the form of a label 24 is applied to the outer package 12 for sealing and concealing the dispensing slit 22. The label 24 can be conventional or as explained in incorporated application Ser. No. 08/684,127. The label 24 includes a pressure-sensitive adhesive on its underside so that the label can be secured to the outer package 12, sealing the dispensing slit 22. Preferably, the adhesive is such that the label can be repeatedly peeled from the package body and reapplied thereto in order to first gain access to the dispensing slit 22, and then reseal the outer package 12. The label 24 also includes a free end 26 which is not underlain by an adhesive and which is therefore free to be grasped by a user for peeling the label 24 back.

Figure 6:
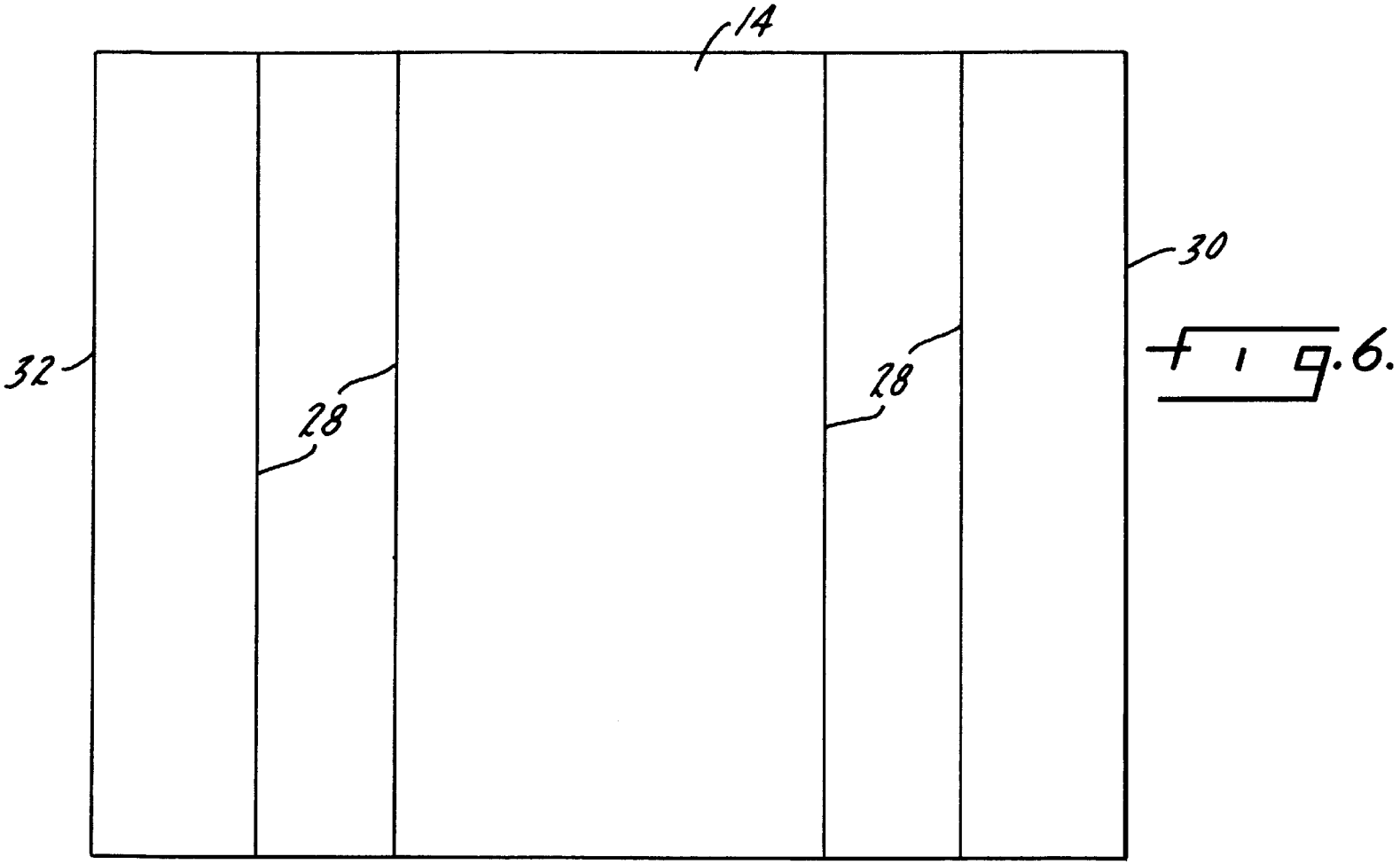
FIG. 6 is a plan view of the insulating and supporting layer of the invention, before being shaped and inserted within the hollow outer package.
Figure 7:
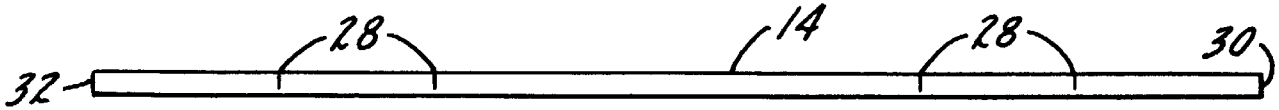
FIG. 7 is a side elevational view of the insulating and supporting layer illustrated in FIG. 6.

The insulating and supporting layer 14 is shown in FIGS. 4, 6 and 7. It preferably comprises a foam sheet, as illustrated in FIGS. 6 and 7, which is shaped to conform to the interior of the outer package 12. For appropriately shaping the insulating layer 14, it includes a series of lateral partial slits 28 located in general registration with the corners of the rectangular outer package 12. Preferably, the slits 28 are slots which extend between opposite edges of the sheet forming the insulating and supporting layer 14, and as depicted in FIGS. 4 and 7, the slits extend sufficiently far through the material of the layer 14 such that the layer 14 can be bent at the slits into the shape illustrated in FIG. 4 for insertion within the outer package 12. Alternatively, the slits 28 could be lines of perforation or other means of weakening the material of the layer 14 such that it bends fully at the slits 28 to form the shape shown in FIG. 4. Also, while not preferred, rather than slits 28 being formed in the sheet, the layer 14 can be formed about a frame (not illustrated) having elements corresponding to the corners of the outer package 12 so that the layer 14, when formed, assumes the shape shown in FIG. 4. Other means of forming the layer 14 will be apparent to one skilled in the art.

The layer 14 terminates at opposite end edges 30 and 32. The edges 30 and 32 are oriented such that when the patient bathing system 10 is formed, the edges 30 and 32 are on opposite sides of the elongated dispensing slit 22. As shown in FIG. 4, the end edges 30 and 32 are spaced, forming a gap 34 in the insulating and supporting layer 14 spanning the elongated dispensing slit 22. In this manner, the insulating and supporting layer 14 does not impede with access to its interior. The material of the package 12 is quite pliable. By spacing the end edges 30 and 32 sufficiently from the dispensing slit 22, the insulating layer 14, which is relatively stiff, does not interfere with removing the washcloths 16 through the slit 22 from an inner cavity 36 formed within the insulating and supporting layer 14 when installed within the outer package 12. Thus, the user can readily withdraw the washcloths 16 as needed, once the label 24 has been peeled to expose the dispensing slit 22.

As illustrated in FIGS. 4 and 5, the washcloths 16 are individual, folded structures which are stacked one atop the other for individual dispensing through the elongated dispensing slit 22. It is preferred that the washcloths 16 be absorbent and be impregnated with a suitable cleansing solution. The washcloths 16 can be made from any appropriate material, and can be a non-woven structure, an open cell foam, a woven structure, a thin sponge, or the like. Preferably, the washcloths 16 are formed with sufficient porosity to hold a desired amount of cleansing solution, as needed. While ten washcloths are illustrated in FIG. 4, any number of washcloths can be used, depending on the sizes of the washcloths and the interior dimensions of the package 12.

Preferably, the insulating and supporting layer 14 extends substantially the entire interior length of the outer package 12, ending just short of the end heat seals 18 where the film of the outer package 12 converges to the end heat seals 18. The layer 14, being formed of a semirigid foam material or the like, not only insulates the interior of the outer package 12, but also shapes the package in its generally rectangular cross-section, thus protecting the washcloths 16 and maintaining uniform dispersion of the cleansing solution contained in the washcloths. The comer slits 28 all of the layer 14 to maintain a generally rectangular inner cavity 36.

The outer package 12 is preferably made of plastic or another material which is generally transparent to microwave energy. Similarly, the insulating and supporting layer 14, which is of a plastic foam or other similar insulative material, is also generally transparent to microwave energy. On the other hand, the cleansing solution contained in the washcloths 16 is a fluid which generally absorbs microwave energy. Accordingly, the patient bathing system 10 can be heated in a microwave oven, heating the washcloths as impregnated by the cleansing solution, while the insulating properties of the insulating and supporting layer 14 help retain heat within the package. Thus, the washcloths 16 can be removed from the package 12 after being warmed, making them far more comfortable than washcloths at room temperature.

Various changes can be made to the invention without departing from the spirit thereof or scope of the following claims.

What is claimed is:

1. A patient bathing system comprising a. a sealed, flexible, hollow outer package, b. means for gaining access to the interior of said outer package, c. an insulating and supporting layer lining at least a portion of said outer package, forming an inner cavity, said insulating and supporting layer not adhering to said outer package, d. a plurality of washcloths disposed within said cavity for dispensing through said access means, and e. means shaping said insulating and supporting layer to form said inner cavity, with said insulating and supporting layer substantially surrounding said washcloths.

2. A patient bathing system according to claim 1 including a cleansing solution impregnating said washcloths.

3. A patient bathing system according to claim 1 in which said access means includes an elongated dispensing slit in said outer package.

4. A patient bathing system according to claim 3 in which said access means further includes a seal extending over said slit and adhering to said outer package.

5. A patient bathing system according to claim 4 in which said seal comprises a resealable label.

6. A patient bathing system according to claim 5 in which said label includes a free end not adhering to said outer package.

7. A patient bathing system according to claim 1 in which said insulating and supporting layer comprises a foam sheet.

8. A patient bathing system according to claim 1 in which said washcloths are formed of absorbent material.

9. A patient bathing system according to claim 1 in which said washcloths are stacked within said inner cavity for one-at-a-time dispensing through said access means.

10. A patient bathing system comprising a. a sealed, flexible, hollow outer package, b. means for gaining access to the interior of said outer package, c. an insulating and supporting layer lining at least a portion of said outer package, forming an inner cavity, d. a plurality of washcloths disposed within said cavity for dispensing through said access means, and e. means shaping said insulating and supporting layer to form said inner cavity, and in which said outer package is generally rectangular in cross section, and said shaping means comprises lateral partial slits in said insulating and supporting layer, said slits being located in general registration with corners of said outer package.

11. A patient bathing system according to claim 10 in which said partial slits comprise slots extending between opposite edges of said sheet.

12. A patient bathing system according to claim 10 in which said sheet includes end edges formed in alignment said access means includes an elongated slit in said outer package, and with said elongated dispensing slit.

13. A patient bathing system according to claim 12 in which said end edges are spaced, forming a gap in said insulating and supporting layer spanning said elongated slit.

14. A patient bathing system according to claim 10 in which said insulating and supporting layer comprises a foam sheet.

15. A patient bathing system comprising a. a sealed, flexible, hollow outer package, b. means for gaining access to the interior of said outer package, c. an insulating and supporting layer comprising a stiff sheet lining at least a portion of said outer package and folded to form an inner cavity, said sheet having spaced end edges forming a gap at said access means, and d. means shaping said insulating and supporting layer to form said inner cavity, with said insulating and supporting layer substantially surrounding the interior of said outer package.

16. A patient bathing system according to claim 15 in which said outer package is generally rectangular in cross section, and said shaping means comprises lateral partial slits in said sheet, said slits being located in general registration with corners of said outer package.

17. A patient bathing system according to claim 16 in which said partial slits comprise slots extending between opposite edges of said sheet.

18. A patient bathing system according to claim 15 including a plurality of washcloths within said cavity, said washcloths being stacked within said inner cavity for dispensing through said access means.

19. A patient bathing system according to claim 15 in which said access means includes an elongated dispensing slit in said outer package.

20. A patient bathing system according to claim 19 in which said access means further includes a resealable label extending over said slit and adhering to said outer package.

21. A patient bathing system comprising a. a sealed, hollow outer package made of a material generally transparent to microwave energy, b. means for gaining access to the interior of said outer package, c. an insulating and supporting layer lining at least a portion of said outer package, forming an inner cavity, said layer being made of a material generally transparent to microwave energy, said layer substantially surrounding said inner cavity, said insulating and supporting layer not adhering to said outer package, and d. at least one washcloth disposed within said cavity for dispensing through said access means, said at least one washcloth being impregnated with a fluid generally absorptive of microwave energy.

22. A patient bathing system according to claim 21 in which said fluid comprises a cleansing solution.

23. A patient bathing system according to claim 21 in which said access means includes an elongated dispensing slit in said outer package.

24. A patient bathing system according to claim 23 in which said access means further includes a seal extending over said slit and adhering to said outer package.

25. A patient bathing system according to claim 24 in which said seal comprises a resealable label.

26. A patient bathing system according to claim 25 in which said label includes a free end not adhering to said outer package.

27. A patient bathing system according to claim 21 in which said insulating and supporting layer comprises a foam sheet.

28. A patient bathing system according to claim 21 including means shaping said insulating and supporting layer to form said inner cavity.

29. A patient bathing system according to claim 28 in which said outer package is generally rectangular in cross section, and said shaping means comprises lateral partial slits in said layer, said slits being located in general registration with corners of said outer package.

30. A patient bathing system according to claim 29 in which said partial slits comprise slots extending between opposite edges of said layer.

* * * * *